US010426228B2

(12) United States Patent
Harden

(10) Patent No.: US 10,426,228 B2
(45) Date of Patent: Oct. 1, 2019

(54) SHOELACE WITH MAGNETS

(71) Applicant: Jordan Harden, St. Louis, MO (US)

(72) Inventor: Jordan Harden, St. Louis, MO (US)

( * ) Notice: Subject to any disclaimer, the term of this patent is extended or adjusted under 35 U.S.C. 154(b) by 721 days.

(21) Appl. No.: 14/662,058

(22) Filed: Mar. 18, 2015

(65) Prior Publication Data

US 2016/0270481 A1 Sep. 22, 2016

(51) Int. Cl.
*A43C 9/00* (2006.01)
*A43B 1/00* (2006.01)

(52) U.S. Cl.
CPC ..... *A43C 9/00* (2013.01); *A43B 1/0054* (2013.01)

(58) Field of Classification Search
CPC .. A43C 7/00; A43C 11/22; A43C 9/04; A43C 9/06
See application file for complete search history.

(56) References Cited

U.S. PATENT DOCUMENTS 1,691,451 A * 11/1928 Uellendahl ..... A43C 9/04 24/715.4
2,049,932 A * 8/1936 Voit ..... A43C 9/06 24/713
4,842,522 A * 6/1989 Alexander ..... A43C 9/00 24/712
6,282,817 B1 * 9/2001 Curet ..... A43C 7/04 24/712.1
7,402,045 B2 * 7/2008 Schwartzbart ..... H01R 11/30 439/38
2006/0196021 A1 * 9/2006 Touzov ..... A43B 1/0054 24/712
2007/0011910 A1 * 1/2007 Keen ..... A43B 3/22 36/50.1
2008/0146864 A1 * 6/2008 Arai ..... A61N 2/06 600/15
2008/0222861 A1 * 9/2008 Son ..... A43B 1/0054 24/712.4
2008/0295305 A1 * 12/2008 Hsu ..... A43C 9/04 24/715.6
2009/0013720 A1 * 1/2009 Altick ..... A44C 5/185 63/3.1
2009/0044566 A1 * 2/2009 Underdown ..... A44C 15/0015 63/3
2009/0229095 A1 * 9/2009 Valdez ..... A43C 1/02 24/713.1
2010/0205791 A1 * 8/2010 Cheng ..... A43B 3/0078 24/715.4
2012/0125046 A1 * 5/2012 Vander Wal ..... A44C 15/003 63/1.18
2014/0259554 A1 * 9/2014 Ruff ..... E05B 75/00 24/303
2015/0040430 A1 * 2/2015 Conrad ..... A43C 1/00 36/83
2015/0257488 A1 * 9/2015 Flores ..... A43C 9/00 24/713

FOREIGN PATENT DOCUMENTS

CN 201504641 U * 6/2010 ..... A43C 9/00
CN 103519510 A * 1/2014 ..... A43C 9/04
GB 191120627 A * 9/1912 ..... A43C 9/04

* cited by examiner

*Primary Examiner* — Megan E Lynch
(74) *Attorney, Agent, or Firm* — Fish & Richardson P.C.

(57) ABSTRACT

A shoelace includes a cord having two ends, two aglets, one at each end of the cord, and two or more magnets integrated within the shoelace.

13 Claims, 5 Drawing Sheets

SHOELACE WITH MAGNETS

TECHNICAL FIELD

This disclosure relates to shoelaces.

BACKGROUND

Shoelaces, sometimes called shoestrings (US English) or bootlaces (UK English), are a system commonly used to secure shoes, boots and other footwear. They typically consist of a pair of strings or cords, one for each shoe, finished off at both ends with stiff sections, known as aglets. Each shoelace typically passes through a series of holes, eyelets, loops or hooks on either side of the shoe. Loosening the lacing allows the shoe to open wide enough for the foot to be inserted or removed. Tightening the lacing and tying off the ends secures the foot within the shoe. Traditional shoelaces were made of leather, cotton, jute, hemp, or other materials used in the manufacture of rope. Modern shoelaces often incorporate various synthetic fibers, which are generally more slippery and thus more prone to coming undone than those made from traditional fibers, although synthetic shoelaces tend to suffer less wear from friction and are less susceptible to rotting from moisture.

SUMMARY

In various implementations, a shoelace as describe herein may include one or more of the following features.

A shoelace may include a cord having two ends, two aglets, one at each end of the cord, and two or more magnets integrated within the shoelace. The shoelace may exactly two magnets, e.g., one disposed at a first location adjacent to one of the two aglets and another disposed at a second location adjacent to the other of the two aglets. The magnets nay be integrated within the shoelace's cord. The cord may be a woven entity formed of a plurality of strands that form a tubular sheath that envelops the magnets. The two or more magnets integrated within the shoelace are disposed inside of the shoelace's cord and are secured with a securing agent. The securing agent may be glue, thread, or clamps. The magnets may be puck shaped, or other than puck shaped (e.g., square or rectangular). The two or more magnets may be configured to be adjoined to form a magnetic bond when brought into sufficient proximity.

In an implementation, the shoelace may include three magnets, wherein the first and second of the magnets are disposed at opposite ends of the shoelace, and the third magnet is disposed near a centerpoint of the shoelace. Alternatively, the shoelace may include four magnets, wherein the first and second of the magnets are disposed at opposite ends of the shoelace, and the third and fourth magnets are disposed near a centerpoint of the shoelace.

In an implementation, a shoelace may include a cord having two ends, two aglets, one at each end of the cord, and three or more magnets integrated within the shoelace, including first and second magnets disposed adjacent opposite ends of the cord, and at least a third magnet disposed in between the first and second magnets.

A method of tying a shoe may involve obtaining a shoelace formed of a cord having two ends, each end having a respective aglet, and a respective magnet, threading the shoelace through eyelets of a shoe to be tied, tying a knot in the shoelace, bringing the ends of the shoelace into sufficiently close proximity such that the magnets in the respective ends of the shoelace form a magnetic bond.

A method of manufacturing a shoelace may involve obtaining a length of cord having a first end and a second end, integrating a first magnet into the cord near the cord's first end, and a second magnet into the cord near the cord's second end, and attaching a first aglet to the cord's first end and a second aglet to the cord's second end. Integrating the first and second magnets into the cord may involve inserting the magnets into an interior portion of the cord. Alternatively, integrating the first and second magnets into the cord may involve forming the cord to encompass the magnets when the cord is being manufactured.

BRIEF DESCRIPTION OF THE DRAWINGS

Like reference numbers and designations in the various drawings indicate like elements.

DETAILED DESCRIPTION

This disclosure relates to shoelaces. The present inventor recognized that shoestrings, especially in response to vigorous activity, tend to loosen or come untied. To alleviate that problem, the present inventor developed a shoe-tying production, named NEOSTRING™, that helps alleviate that problem.

Figure 1:
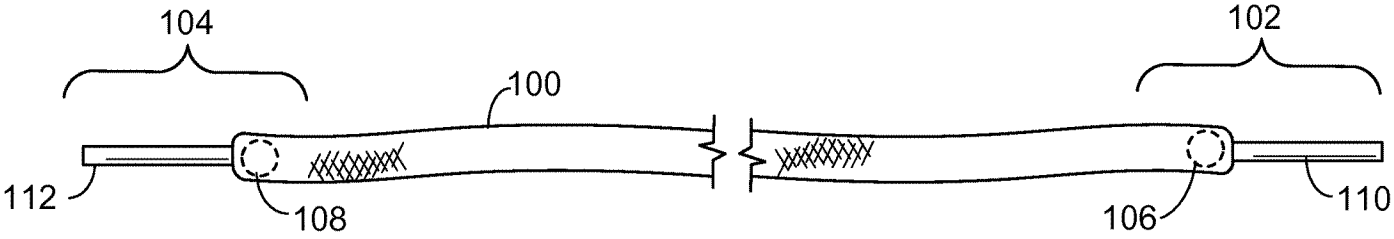
FIG. 1 illustrates a shoelace having two integrated magnets, one near each end.

As shown in FIG. 1, the NEOSTRING™ shoelace includes a cord 100 having two ends, 102 and 104, each of which includes an aglet (110, 112) and an integrated magnet (106, 108). If the cord 100 is woven, the magnets 106, 108 can be positioned inside the cord by pulling apart individual strands of the woven cord 100 to create an opening to an inside cavity of the cord 100, inserting the magnets 106, 108, and then securing the magnets 106, 108 in place, e.g., by using glue or stitching them in place using needle and thread. Alternatively, the magnets 106, 108 can be positioned inside the cord 100 by any other suitable means, for example, during manufacture of the shoelace. Each of the magnets 106, 108 have opposing positive and negative magnetic poles to facilitate attraction and retention, when placed in proximity to each other.

Figure 2:
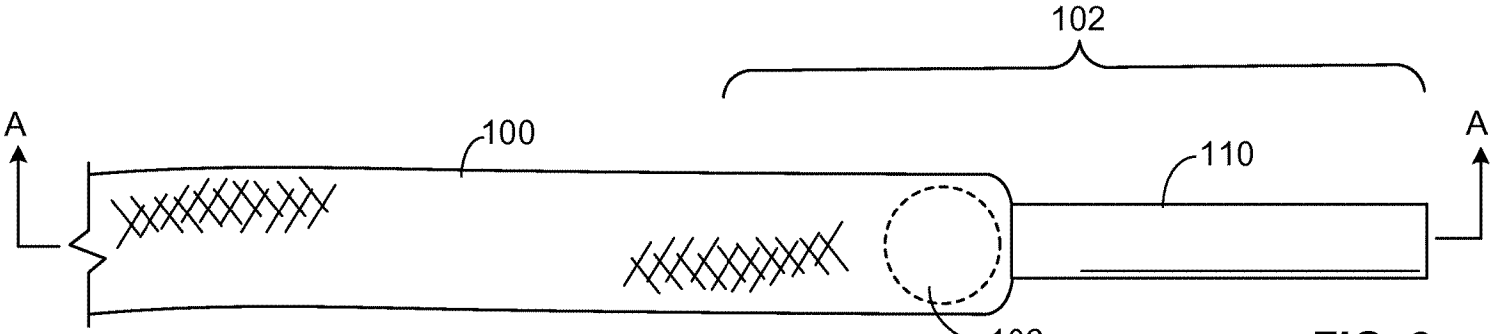
FIG. 2 illustrates a close-up view of an end of a shoelace having a magnet integrated within the shoelace adjacent to the aglet.

FIG. 2 shows a close-up view of a portion of the shoelace. As shown therein, the magnet 106 (shown in dotted lines to indicate that it is enveloped by the cord 100) is disposed at the end 102 adjacent to, and abutting, the aglet 110.

Figure 3:
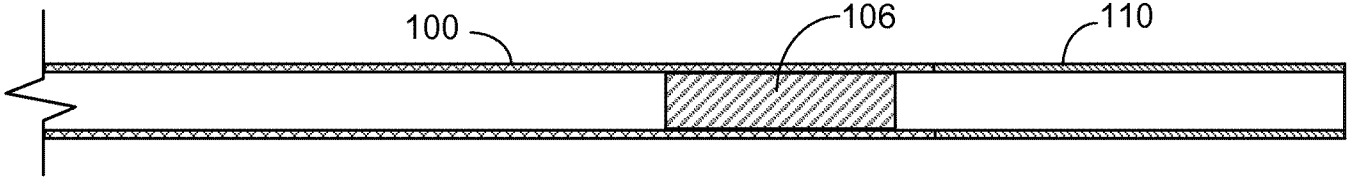
FIG. 3 illustrates a cross-section A-A of the shoelace shown in FIG. 2.

FIG. 3 shows a cross-sectional view of the shoelace portion shown in FIG. 2 taken along line A-A. Although the magnets 106, 108 shown in FIGS. 1-3 are depicted as being cylindrical or puck-shaped, any other suitable shape may be used, for example, square, rectangular, or the like.

Figure 4:
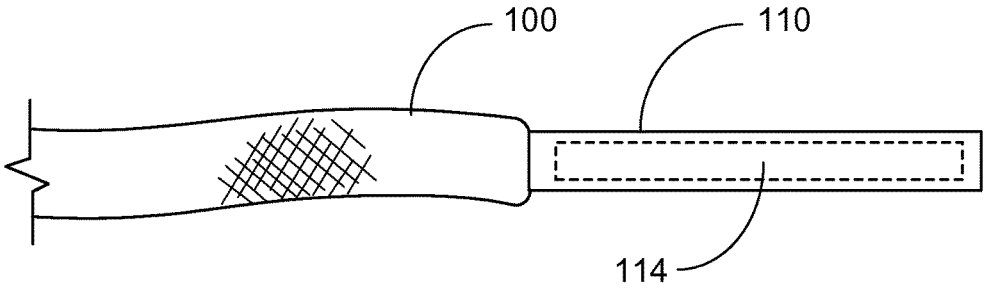
FIG. 4 illustrates a close-up view of an end of a shoelace having a magnet integrated within the aglet.

FIG. 4 shows an alternative implementation in which a magnet 114 is integrated within the aglet 110. This implementation can be used instead of, or in addition to, the implementation in which the magnet 106 is integrated into the cord 100 adjacent to the aglet 110.

Figure 5A:
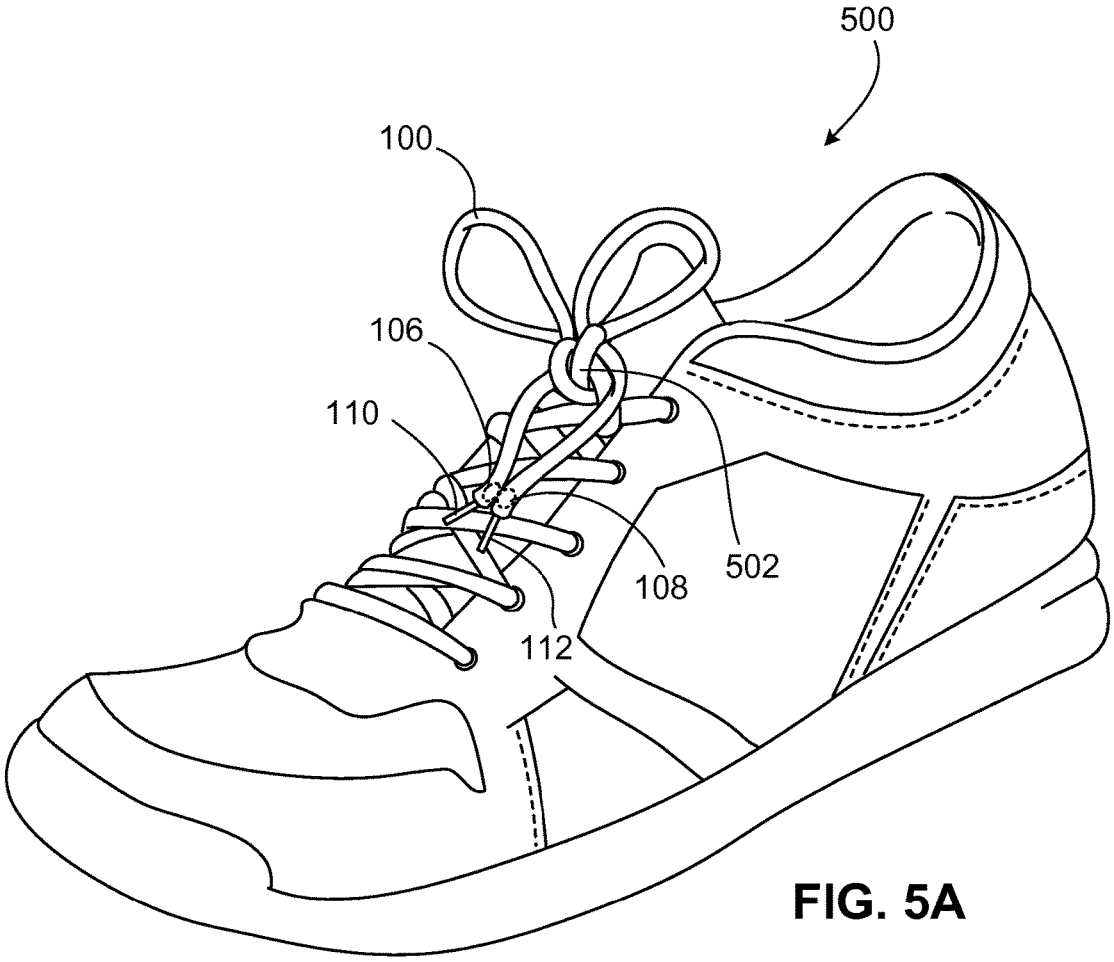
FIGS. 5A and 5B illustrate an exemplary use case for the shoelace shown in FIG. 1.
Figures 5B, 6A:
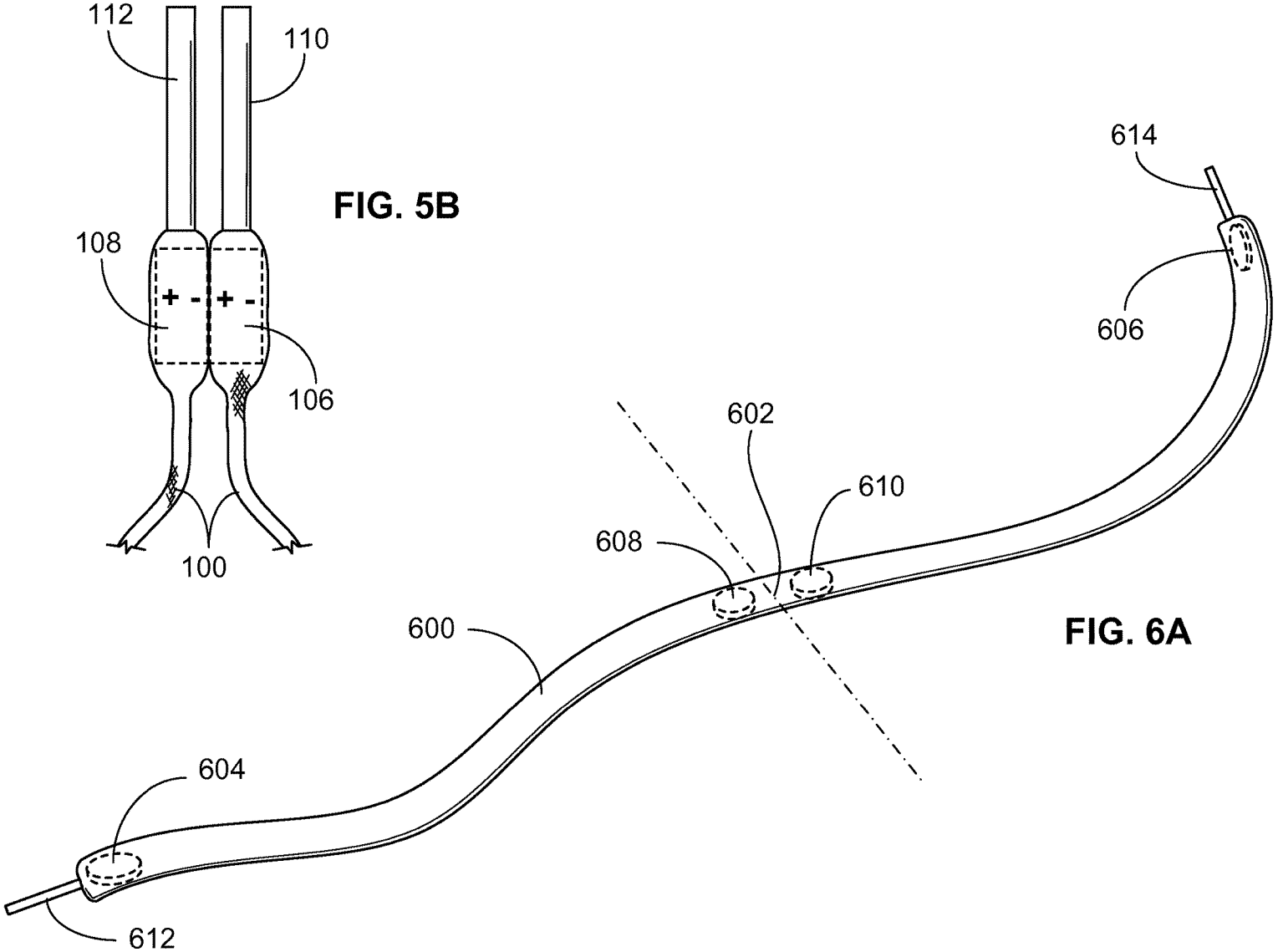
FIG. 6A illustrates a shoelace having four integrated magnets, one near each end and a pair of center magnets positioned near the shoelace's center-point.

FIGS. 5A and 5B illustrate an exemplary use case for the shoelace shown in FIG. 1. As shown in FIG. 5A, the NEOSTRING™ shoelace has been threaded through the eyelets of a shoe 500, and tied to form a knot 502. With conventional shoelaces the ends of a tied shoelace would dangle on either side of the shoe and potentially flop around as the wearer moved around. But with NEOSTRING™ shoelaces, after tying the knot 502, the wearer brings the ends 110, 112 into proximity with each other such that their respective integrated magnets 106, 108 come close enough that their respective magnetic forces attract one to the other and holds them in a magnetically bonded state, as shown. This magnetically bonded state provides several potential advantages. For example, by having the ends 102, 104 of the shoelace magnetically bonded together, the shoelace is less likely to come untied during normal wear and usage. Moreover, while remaining tied, the magnetic bond prevents the shoelace ends 102, 104 from flopping around side-to-side, or up-and-down, as the wearer moves around. More generally, the magnetic bond provided by the NEOSTRING™ shoelaces gives a cleaner, more organized look to a pair of tied shoes.

As shown in FIG. 5B, it is important for the magnets 106, 108, when brought into proximity with each other, to be oriented such that the negative pole of one magnet opposes the positive pole of the other magnet. Otherwise, instead of an attractive magnetic force, the two magnets would repel each other (that is, if the magnets 106, 108 were brought together such that like poles opposed each other). As a practical matter, magnets of sufficiently high power can be used so that they effectively self-align (e.g., flip over, if needed) to have opposite poles opposing each other when brought into sufficiently close proximity.

Figure 6B:
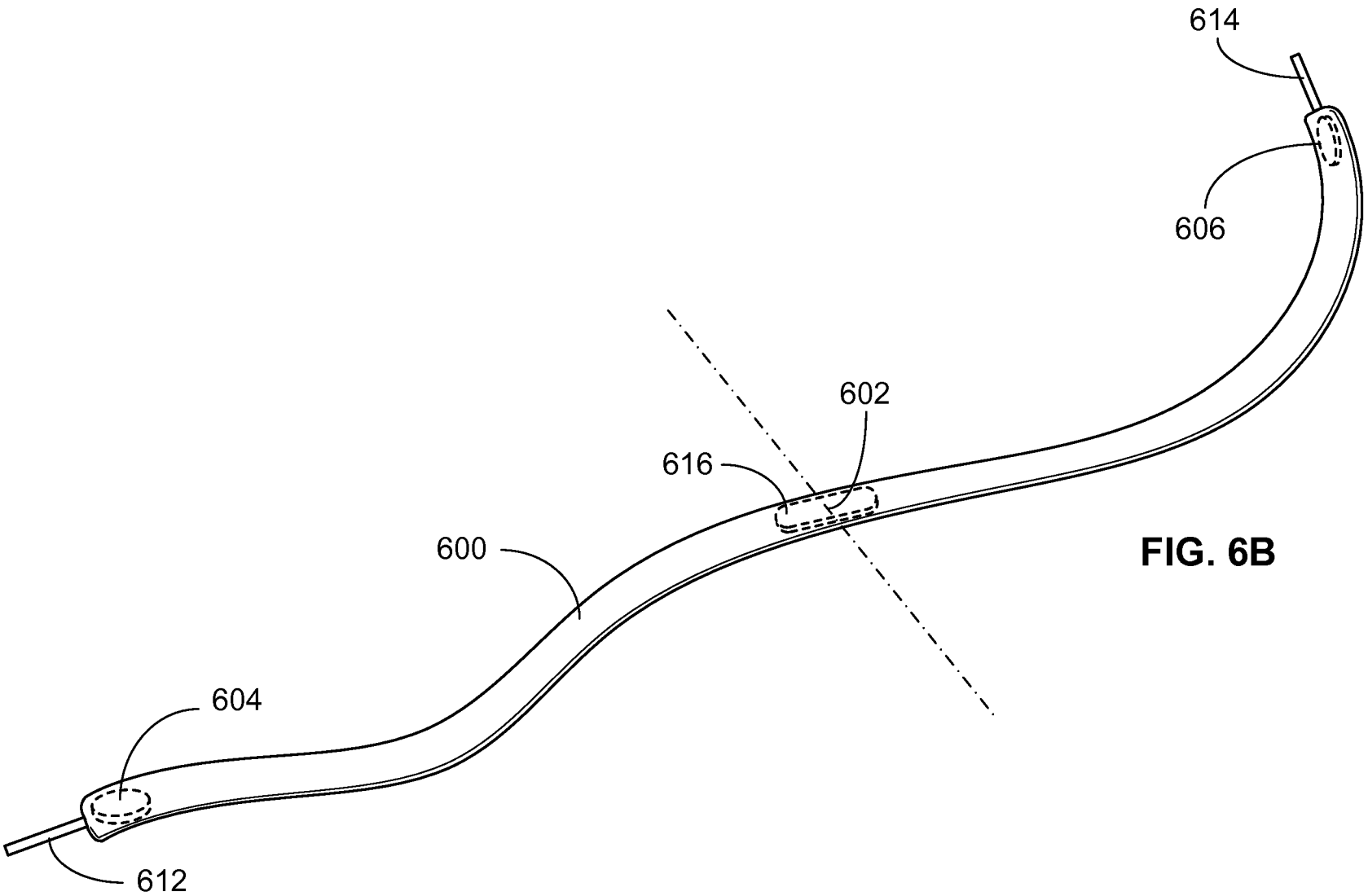
FIG. 6B illustrates a shoelace having three integrated magnets, one near each end and a center magnet positioned near the shoelace's center-point.

FIGS. 6A and 6B show an alternative implementations of the NEOSTRING™ shoelaces in which more than two integrated magnets are used, in the examples shown, four and three, respectively. In the implementation of FIG. 6A, the shoelace is formed of a cord 600 having an aglet 612, 614 and an end magnet 604, 606 at each end as in the two-magnet implementation. But this implementation adds one or more additional magnets, for example, center magnets 608, 610, one each adjacent to a center point 602 of the shoelace. The purpose of these additional center magnets 608, 610, explained in more detail in FIG. 7, is to form magnetic bonds with end magnets 604, 606, respectively, when the shoelace is installed in the shoe.

Although the example shown in FIG. 6A depicts two additional center magnets 608, 610 positioned adjacent to the shoelace's center point 602, various other configurations may be used. For example, instead of two magnets near the center point, a single additional magnet (e.g., center magnet 614 shown in FIG. 6B) could be used to which both end magnets 604, 606 would form magnetic bonds. In addition, the additional one or more magnets need not be near or adjacent to the center point of the shoelace but rather can be at essentially any other location within the shoelace, for example, further up toward the aglets.

Figure 7:
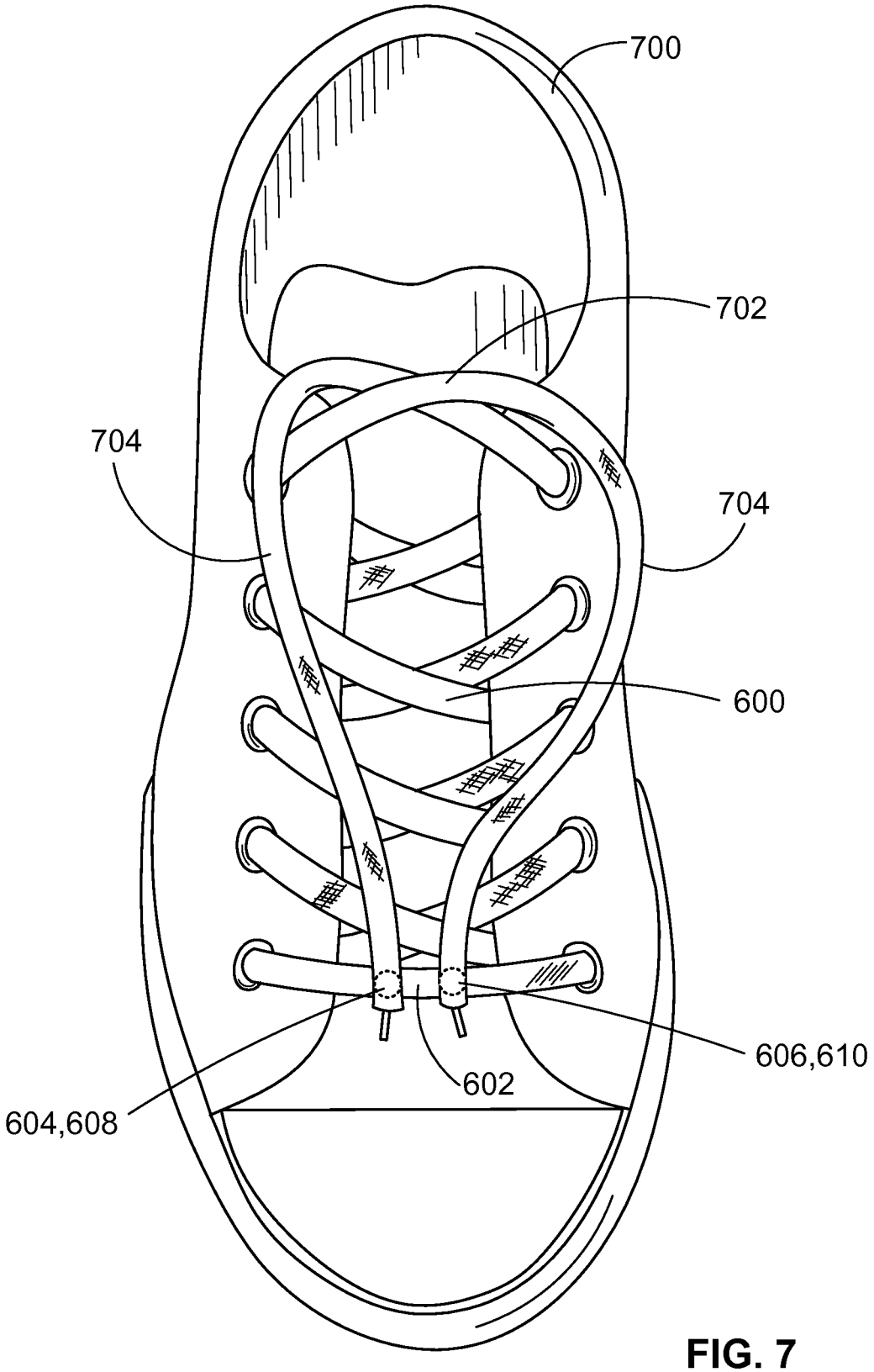
FIG. 7 illustrates an exemplary use case for the shoelaces shown in FIGS. 6A and 6B.

FIG. 7 shows an exemplary use case of the shoelaces shown in FIGS. 6A and 6B. As shown, the shoelace 600 is threaded through the eyelets of a shoe 700. At 702, the shoelace 600 can be tied into a knot, or simply looped together, or left untied altogether, leaving two remaining portions 704, each having a respective end magnet 604, 606 adjacent to its aglet 612, 614. In this three or more magnet implementation (four as shown), the shoelace portions 704 are positioned such that their respective end magnets 604, 606 come within close proximity to respective center magnets 608, 610, and form magnetic bonds there between. In this manner, the shoelaces are held in position so that they do not come loose or otherwise flop around.

The NEOSTRINGS™ described here can be customized in any of several ways to the wearer's preference. For example, the color, type and material of the aglet can be customized, as can the colors, materials used for the shoelace cord, length, coating (e.g., waterproofing), A number of implementations have been described. Nevertheless, it will be understood that various modifications can be made without departing from the spirit and scope of the invention.

What is claimed is:

1. A shoelace comprising:

a cord having two ends;

two aglets, one at each end of the cord; and three or more magnets integrated within the shoelace, wherein the three or more magnets include a first magnet disposed at a first location within or adjacent to one of the two aglets, a second magnet disposed at a second location within or adjacent to the other of the two aglets, and a third magnet disposed at a centerpoint of the cord.

2. The shoelace of claim 1, wherein the magnets are integrated within the shoelace's cord.

3. The shoelace of claim 2, wherein the cord comprises a woven entity formed of a plurality of strands that form a tubular sheath that envelops the magnets.

4. The shoelace of claim 1 wherein the three or more magnets integrated within the shoelace are disposed inside of the shoelace's cord and are secured with a securing agent.

5. The shoelace of claim 4 wherein the securing agent comprises glue, thread, or clamps.

6. The shoelace of claim 1 wherein the magnets are disc shaped.

7. The shoelace of claim 1 wherein at least one of the magnets has a shape other than disc-shaped.

8. The shoelace of claim 1 wherein the three or more magnets are configured to be adjoined to form a magnetic bond when brought into sufficient proximity.

9. The shoelace of claim 1 comprising four magnets, wherein the first and second of the magnets are disposed at opposite ends of the shoelace, and the third and fourth magnets are disposed at the centerpoint of the shoelace.

10. A method of tying a shoe, the method comprising:

obtaining a shoelace formed of a cord having two ends, each end having a respective aglet, and a respective magnet, the shoelace further having a magnet disposed at a centerpoint of the shoelace;

threading the shoelace through eyelets of a shoe to be tied;

tying a knot in the shoelace; and bringing the ends of the shoelace into sufficiently close proximity to the centerpoint of the shoelace such that the magnets in the respective ends of the shoelace form a magnetic bond with the magnet disposed at the centerpoint of the shoelace.

11. A method of manufacturing a shoelace, the method comprising:

obtaining a length of cord having a first end and a second end;

integrating a first magnet into the cord near the cord's first end, a second magnet into the cord near the cord's second end, and a third magnet at a centerpoint of the cord; and attaching a first aglet to the cord's first end and a second aglet to the cord's second end.

12. The method of claim 11 wherein integrating the first, second, and third magnets into the cord comprises inserting the magnets into an interior portion of the cord.

13. The method of claim 11 wherein integrating the first, second, and third magnets into the cord comprises forming the cord to encompass the magnets when the cord is being manufactured.

* * * * *